US006225963B1

(12) United States Patent
Vortmeier

(10) Patent No.: US 6,225,963 B1
(45) Date of Patent: May 1, 2001

(54) CLOVERLEAF SPIRAL ANTENNA AND ARRAY

(75) Inventor: Frederick W. Vortmeier, Ferguson, MO (US)

(73) Assignee: McDonnell Douglas Corporation, Seal Beach, CA (US)

( * ) Notice: Subject to any disclaimer, the term of this patent is extended or adjusted under 35 U.S.C. 154(b) by 0 days.

(21) Appl. No.: 06/329,725

(22) Filed: Dec. 11, 1981

(51) Int. Cl.[7] ..... H01Q 1/36
(52) U.S. Cl. ..... 343/895
(58) Field of Search ..... 343/895, 700 MS

(56) References Cited

U.S. PATENT DOCUMENTS 2,482,767 * 9/1949 Hansen ..... 343/895
2,977,594 * 3/1961 Martson et al. ..... 343/895
3,246,245 * 4/1966 Turner ..... 343/895
3,343,089 * 9/1967 Murphy et al. ..... 343/895
4,309,706 * 1/1982 Mosko ..... 343/895

FOREIGN PATENT DOCUMENTS

271592 * 5/1970 (SU) ..... 343/895

* cited by examiner

*Primary Examiner*—Theodore M. Blum

(57) ABSTRACT

A broadband spiral antenna wherein the outermost spirals for lower frequency operation are formed in the shape of a four lobed cloverleaf so that the low frequency operation can be provided in a relatively limited space leaving room for four other spiral antennas between the lobes so that two orthogonal arrays of three antennas each with the center cloverleaf antenna being common to both arrays can be used to determine the directional characteristics of a radiating source being detected.

10 Claims, 6 Drawing Sheets

CLOVERLEAF SPIRAL ANTENNA AND ARRAY

BACKGROUND OF THE INVENTION

It is desirable to have radar detection systems which can detect emissions over a wide frequency range. For such systems to operate effectively, suitable antennas are required which can efficiently capture the radar signals. When the antennas are to be located on aircraft, a significant problem exists in finding space for the antennas both because suitable space on aircraft is extremely limited and there is a need that the detection antenna not interfere with normal aircraft operations.

Several antennas exist that cover the 0.5 GHz to 18 GHz frequency band. These antennas provide lower band coverage either by wiring helices around a cylindrical surface placed at right angles to the beam or by using a normal 2–18 GHz antenna at the 0.5–2 GHz frequencies and accepting additional gain losses and pattern degradation. For the prior art antennas which include helices, excessive depth behind the mold line is required, and additional space is required around the antenna at the mold line to allow energy to reach the helices. This in turn increases the required spacing to adjacent antennas affecting the phase tracking ability of such antenna when arrayed. The gain of the helix antennas at the low end of the frequency band is only −15 dBi while the gain of the normal 2–18 GHz antenna, at the low band is only −30 dBi. The pattern performance of the normal 2–18 GHz antennas is poor at low frequencies because of the small antenna aperture available.

Other antennas exist that cover the lower band efficiently having large radiating areas which make them efficient. However, the antennas of this type do not operate effectively at the higher frequencies and therefore multiple antenna locations must be provided which is difficult especially when the antennas are retrofitted to an existing aircraft.

It is also possible to construct an antenna that will efficiently operate over the total frequency band of 0.5–18 GHz including the lower frequencies by enlarging the diameter of conventional spirals to include the lowest desired frequency. This antenna at 0.6 GHz would require a diameter of about 6.8 inches. Such an antenna, although large, would work as a radar warning antenna. However, it could not be used in an array because of the required excessive spacing between adjacent antennas. This severely limits its usefullness in radar detection because bearing information which can be obtained from an array is almost as important to determine as the existance of the radar emission in the first place.

BRIEF DESCRIPTION OF THE PRESENT INVENTION

The present cloverleaf antenna basically is a spiral antenna having a pair of printed circuit elements which are circularly spiral at the center portion thereof. Four other similar spiral antennas can be included at the sides of the center portion to form longitudinal and lateral arrays with the center portion. The elements of the center portion are extended outwardly in a cloverleaf fashion so that the four cloverleaf lobes formed by the spiral elements are located on the diagonals between the other array forming spiral antennas. The element portions of the cloverleaf lobes convert a normal 2 to 18 GHz spiral array into one that can also handle frequencies down to 0.6 GHz while keeping the same array envelope and providing a higher gain than prior art antennas of larger size.

Therefore it is an object of the present invention to provide a wide band antenna and antenna array in the same array envelope as existing arrays of smaller frequency range.

Another object is to provide a wide band radar warning antenna which can be produced easily and simply using printed circuit techniques.

Another object is to provide a radar warning array which requires a minimum of depth for incorporation into a moving platform such as an aircraft.

Another object is to provide an antenna which can be flush mounted and is relatively small in size having a nominal beamwidth near 80° and a near constant gain over most of a wide frequency band.

These and other objects and advantages of the present invention will become apparent to those skilled in the art after considering the following detailed specification in conjunction with the accompanying drawings wherein:

DETAILED DESCRIPTION OF THE SHOWN EMBODIMENT

Figure 1:
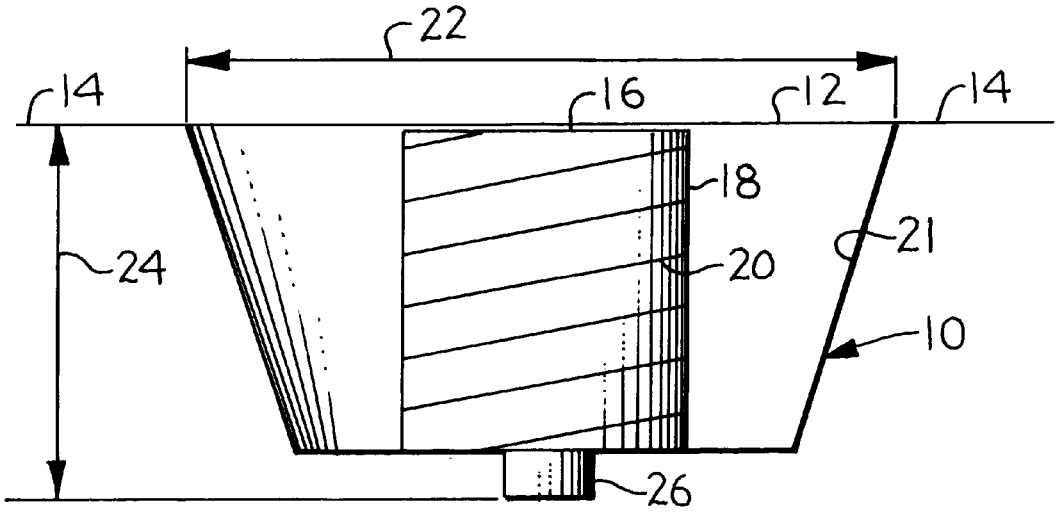
FIG. 1 PRIOR ART
FIG. 1 is a diagrammatic cross-sectional view of a typical prior art antenna having a helical portion for 0.5–2 GHz signals.

Referring to the drawings more particularly by reference numbers, number 10 refers to a typical prior art 0.5–18 GHz antenna installation. The prior art antenna 10 includes a fiberglass cover 12 flush with a mold line 14 having therebehind a flat, two element spiral, circular radiating surface 16 for 2–18 GHz and a cylindrical surface 18 about which a helical antenna 20 is provided for the 0.5–2 GHz range. The antenna 20 usually is faced by a conical absorber 21. Antennas, such as antenna 10, typically have a diameter 22 of 6.96 inches and a depth 24 of 3.54 inches from the flush mounted fiberglass cover 12 to the antenna connector 26.

Figure 3:
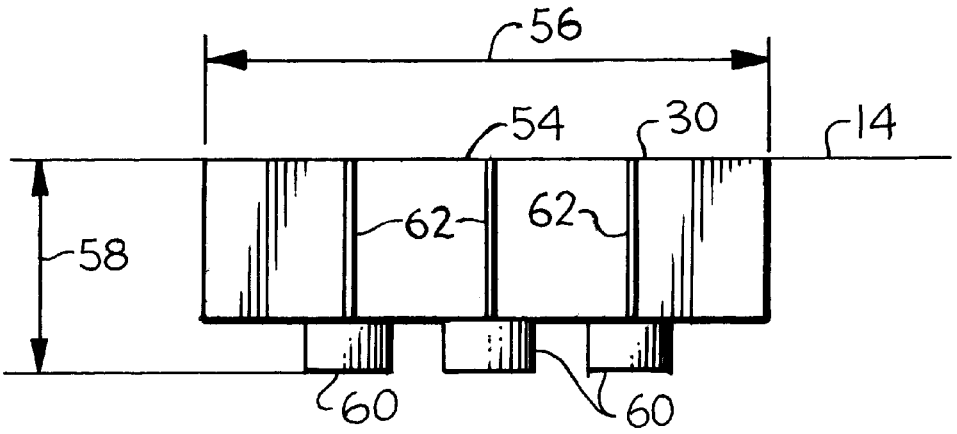
FIG. 3 is a diagrammatic cross-sectional view similar to FIG. 1 of the antenna shown in FIG. 2.
Figure 2:
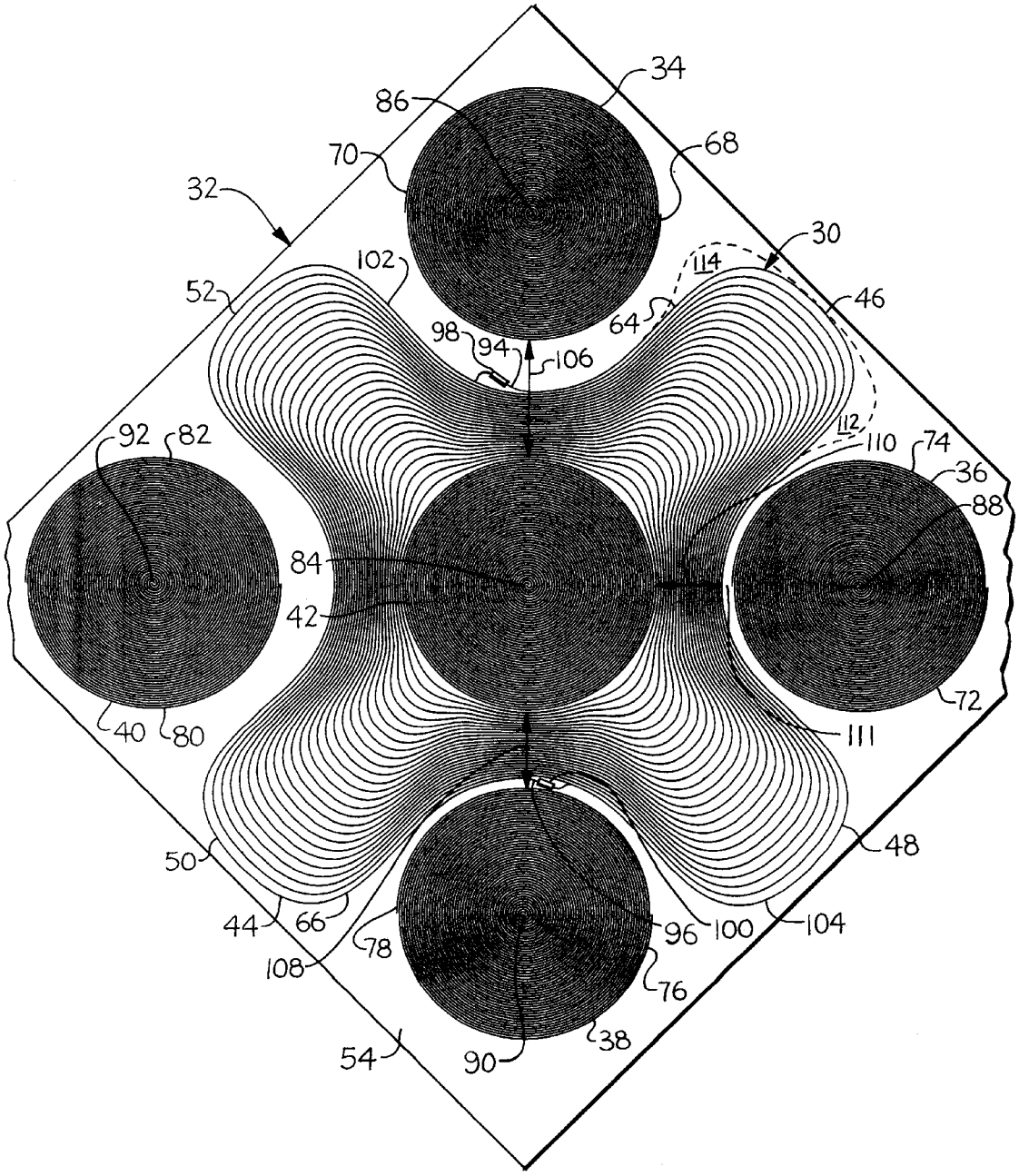
FIG. 2 is a front view of the present cloverleaf antenna and four other spiral antennas incorporated into an array.

The antenna 30 of the present invention is shown in FIGS. 2 and 3. The antenna 30 is a spiral antenna which can provide low frequency coverage and be used in an array such as the array 32 shown including four spiral antennas 34, 36, 38 and 40. The antenna 30 includes a center spiral portion 42 similar to spiral antennas 34, 36, 38 and 40 with a cloverleaf portion 44 having its lobes 46, 48, 50 and 52 located between antennas 34 and 36, 36 and 38, 38 and 40 and 40 and 34 respectively.

The antenna array 32 shown in FIG. 2 preferably is formed by conventional printed circuit techniques on a metal clad insulating plate 54. For a frequency range of 0.5–18 GHz, the plate 54 can be as small as 5.25 inches square, as shown by arrow 56 (FIG. 3), whereas the overall antenna need be only 2 inches in depth 58 from the plate 54 to the antenna connectors 60 to which the antennas are connected by leads 62. The antennas 30, 34, 36, 38 and 40 each have a pair of spiral elements 64 and 66, 68 and 70, 72 and 74, 76 and 78, and 80 and 82 respectively. Normally, the elements 64, 66, 68, 70, 72, 74, 76, 78, 80 and 82 are connected to the leads 62 at centers 84, 86, 88, 90 and 92. For optimum VSWR, it is also desirable to terminate the outer ends 94 and 96 of the elements 64 and 66 at least for the cloverleaf portion 44. This is done by connecting resistors 98 and 100 between the ends 94 and 96 and the adjacent inward turn 102 and 104 of the elements 64 and 66. The resistors 98 and 100 are sized to the characteristic impedence of the cloverleaf portion 44.

The cloverleaf spiral antenna 30 usually is used as a flush mounted receiving antenna that will efficiently receive signals over the frequency band from 0.6 GHz to 18 GHz. It has the advantage of interlacing with the other spiral antennas 34, 36, 38 and 40 in the array 32 although the antenna 30 also can operate independently. The primary use of the antenna array 32 is for radar warning. However, it can be used whenever a broad beamwidth receive antenna is required that must operate over a wide frequency range. It has a normal beamwidth of about 80° and a near constant gain over most of the frequency bands.

The antenna 30 operates because radiation occurs in narrow rings on the antenna face with the circumference of the radiating ring being equal to the wavelength at the radiating frequency. Therefore, as a lower frequency is required, the antenna becomes larger. For example, for 0.5 GHz the minimum diameter of a circular antenna would be 7.52 inches. When a higher frequency is required a very small radius winding must be present. For example, for 18 GHz the diameter of the ring must be 0.21 inches. Therefore, to cover 0.5 GHz to 18 GHz with the conventional type spiral antenna, it must be at least 7.52 inches in diameter and include windings at its center that are less than 0.21 inches in diameter. The lowest radiating frequency determines the diameter and the highest frequency determines the width of the spiral windings and the spacing between adjacent windings. Antennas operating up to 18 GHz commonly use spiral arms that are 0.10 inches or less wide and have a spacing between adjacent windings that allows a gap which is equal to the width of the spiral arms. For lower frequency operation the antennas become excessively large and other approaches are used to obtain antennas with smaller more suitable diameter.

Spiral antennas can detect threats over wide angles and frequency bands. However, in addition to knowing that a threat exist, it is important to know the direction to the radiating source so that either evasive action or an attack can be initiated. Arrays of spiral antennas are therefore used to determine the angle of arrival of such threatening radiation source. It is standard procedure to use two orthogonal arrays of three antennas each, with one of the antennas being common to both arrays, such as for example antennas 36 and 40 and center portion 42 or antennas 34 and 38 and center portion 42. As stated earlier, the diameter of the antenna is determined from the lowest frequency of interest. This in turn establishes the minimum spacing between the adjacent antennas. However, a spacing which works well for the lowest operating frequency is troublesome for the higher frequencies. As the center line to center line spacing of the antennas becomes more than a half free space wavelength, ambiguities exist causing confusion in determining the correct angle of arrival. To overcome these ambiguities the third antenna is included. The spacings 106 and 108 between the first and second antennas like 34 and 42 and the second and third antenna like 42 and 38 of each linear array are made different by slightly less than half a wavelength. Then with two sets of antennas having different base legs, the ambiguities can be mathematically resolved. Two such arrays orthogonally located will determine the angle of arrival for most of the hemisphere over the total freqency band of interest.

When the required operating frequency is below 2 GHz it becomes difficult to find locations on a combat aircraft that will accommodate a five element array required for phase measurements. A less accurate amplitude measuring system is then employed which requires only a single antenna per quadrant. The cloverleaf antenna 30 is such an antenna which can be integrated into an existing phased array.

As a specific example, an antenna array similar to array 32 was developed which includes a warning capability for frequencies as low as 0.6 GHz. Lower frequency operation down to 0.6 GHz was added to a normal 2–18 GHz spiral array to serve as a radar warning system at the lower frequencies. To keep the same array envelope as the exiisting arrays, the diameter of the five spiral elements was decreased to two inches and the outer antenna elements were moved outward by the amount of the decreased antenna radius. Doing this provided additional space between the outer antennas such as 34, 36, 38 and 40 and the center antenna 42. This space was used to extend the spiral arms of the center antenna to form the cloverleaf 44 portion. This extention fills all the void area on the face of the array 32. As can be seen in FIG. 2, the space between the outer antennas 34, 36, 38 and 40 is uniformally filled in a symmetrical fashion. This shape and its size was determined from the lowest required frequency. The path length of the outer most turn of the cloverleaf portion 44 is equal to a wavelength at 0.55 GHz which provided adequate operation at 0.6 GHz. The number of turns in the cloverleaf portion 44 of the antenna 30 was determined by the number of turns that could be placed between the center spiral portion 42 and the closest outer spiral antenna 36 or 38. The area bounded by the largest turn of the cloverleaf portion 44 and its circular spiral portion was then divided into the same number of increments to uniformally fill the available space 110. A minimum of 0.1 inch spacing 111 was maintained from the cloverleaf 44 to the outer spiral antennas 36 and 38. In an application where still lower frequencies must be detected with the same antenna envelope, it is possible to curve the lobes into open areas such as areas 112 and 114 to provide a longer path while maintaining the spacing 111 and hence accommodate lower frequencies. This is shown in dashed outline for one lobe 46 in FIG. 2.

With the addition of the cloverleaf 44 to a standard antenna array, a good low band warning capability can be added. In addition, since normally an array, such as array 32, is located at each cardinal point about the aircraft, an excellent amplitude direction finding capability exists. Preliminary data indicates that the performance of the cloverleaf low band system 32 is superior to the low band capability of the prior art antenna systems. A real advantage of the antenna system 32 is that it can be collocated with other antennas and does not require additional space on the aircraft.

Other antenna arrays can be constructed with the antennas 30, 34, 36, and 40 of FIG. 2. For example, array 116 of FIG.

Figure 4A:
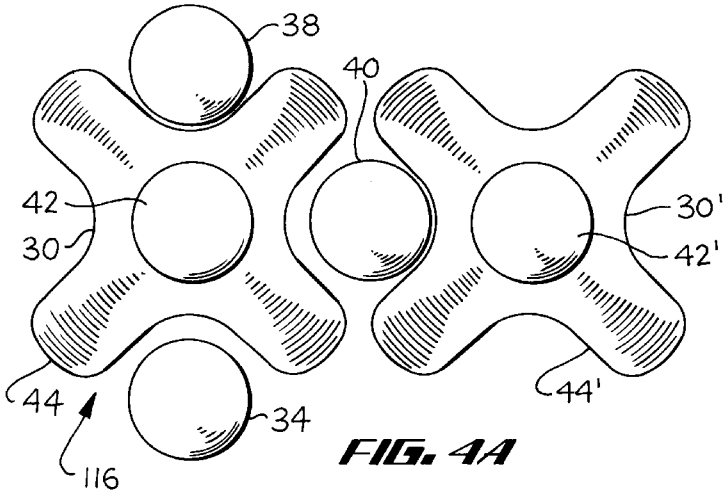
FIGS. 4A, 4B, and 4C are outlines of various arrays typical of the arrays that can be created with the antenna of FIGS. 2 and 3.
Figure 4B:
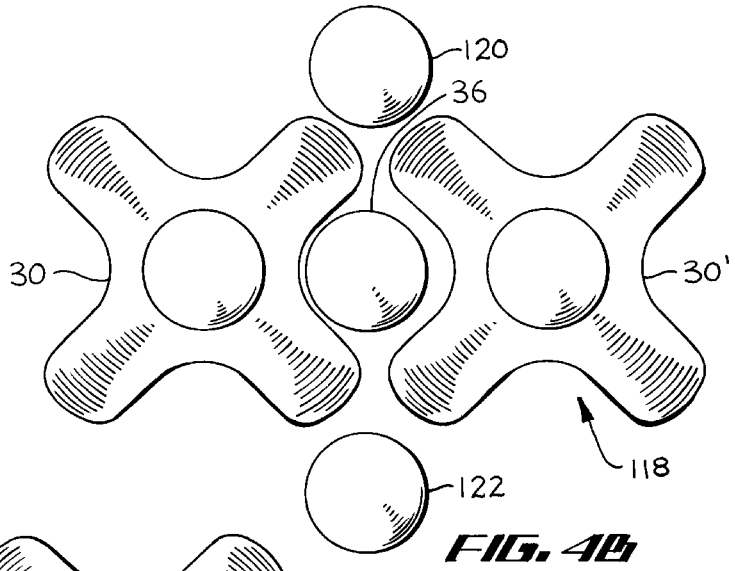
Figure 4C:
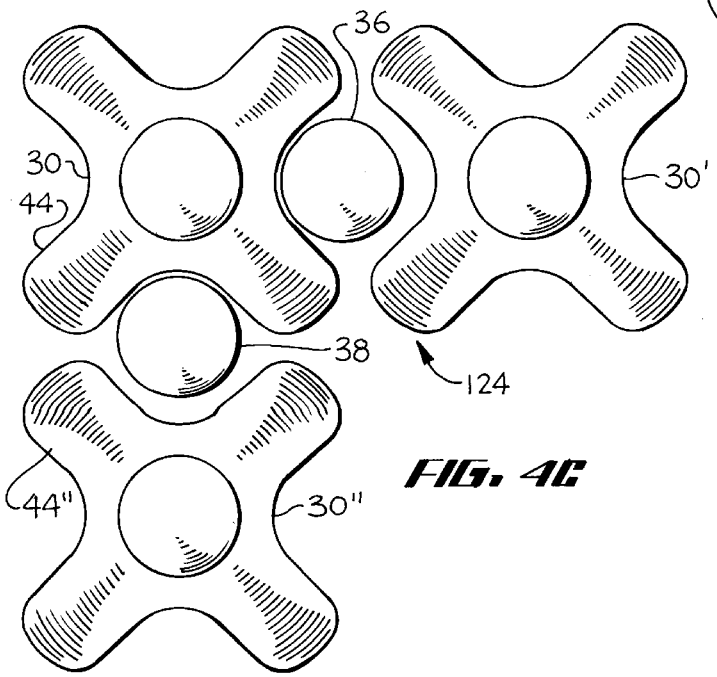
Figure 5A:
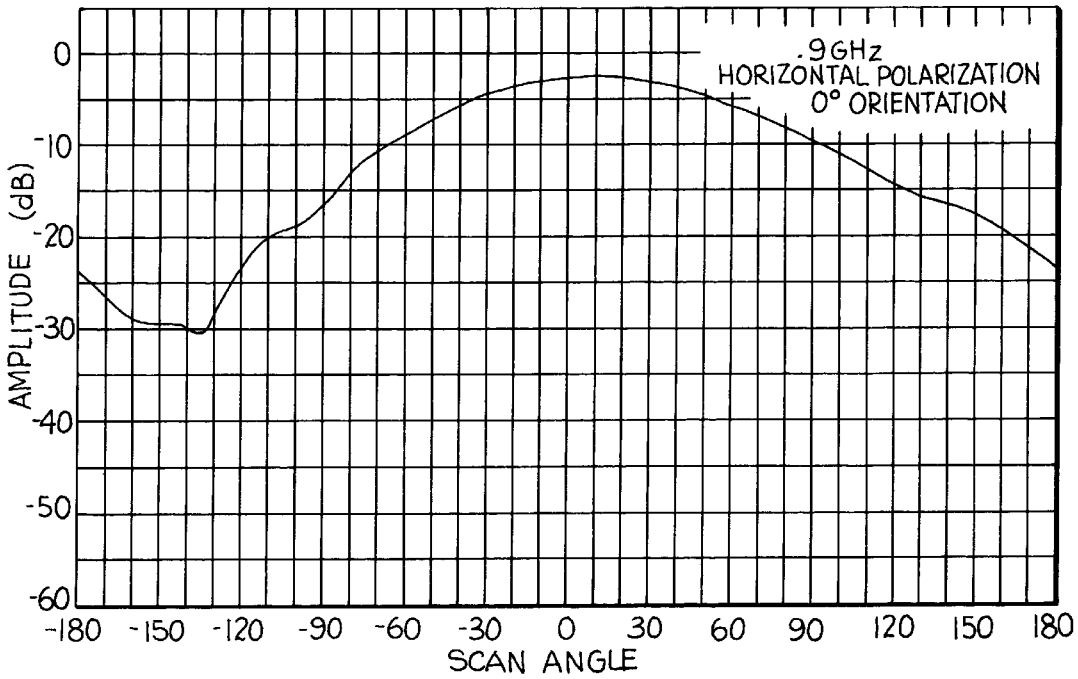
FIGS. 5A, 5B, 5C and 5D are sample antenna patterns of amplitude versus scan angle for the antenna of FIGS. 2 and 3.
Figure 5B:
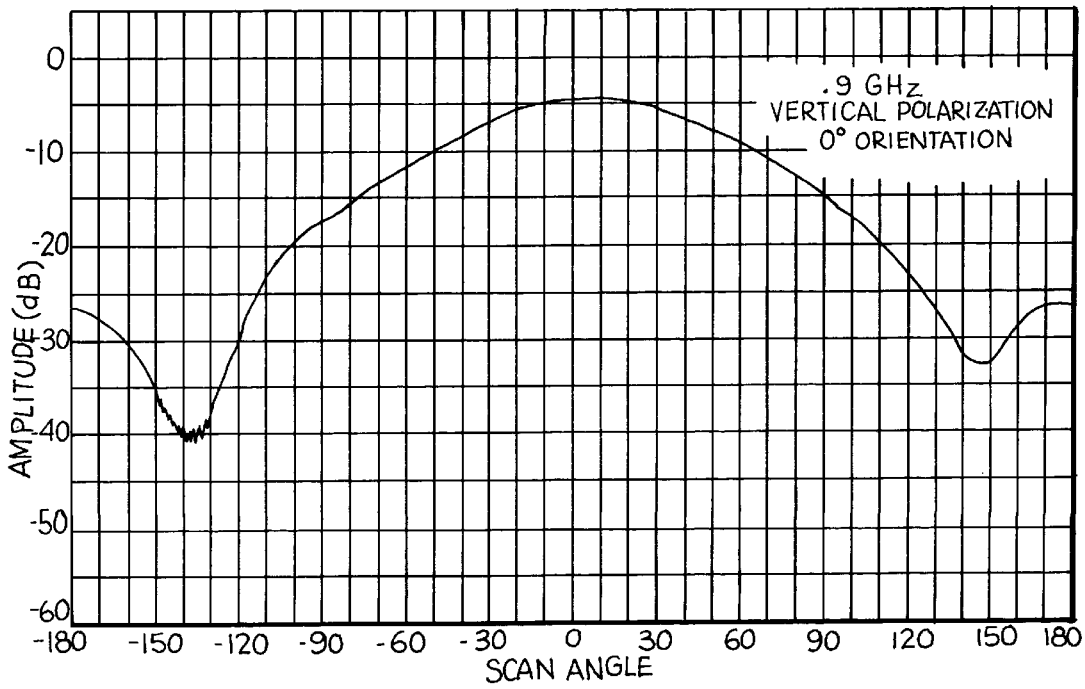
Figure 5C:
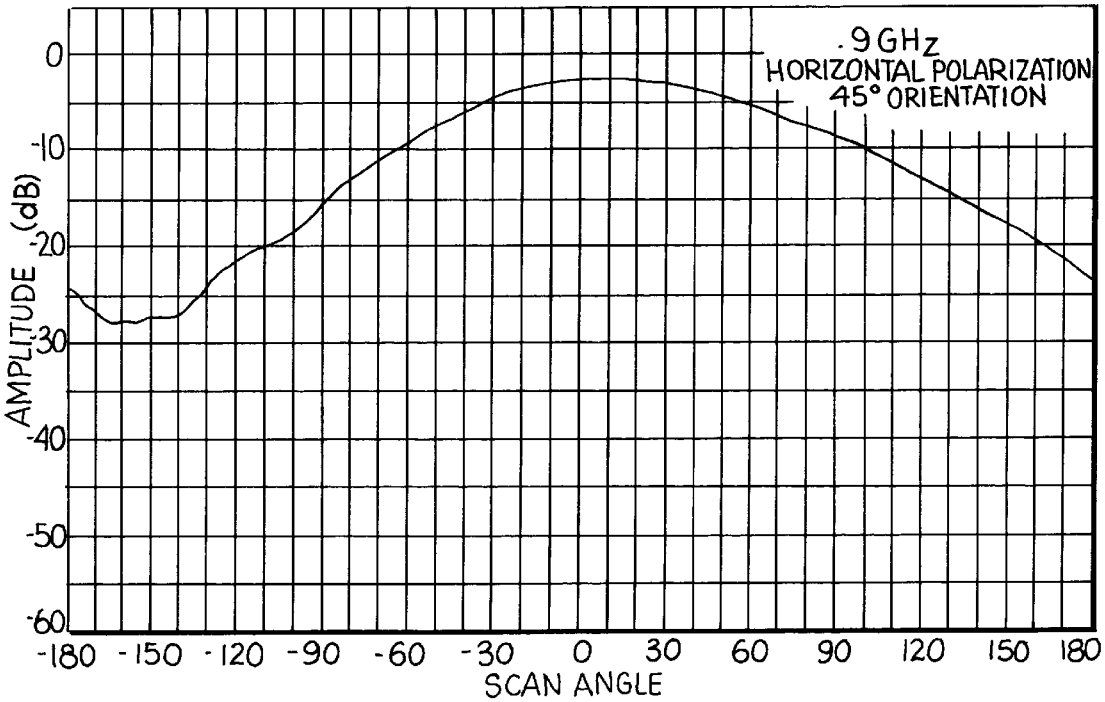
Figure 5D:
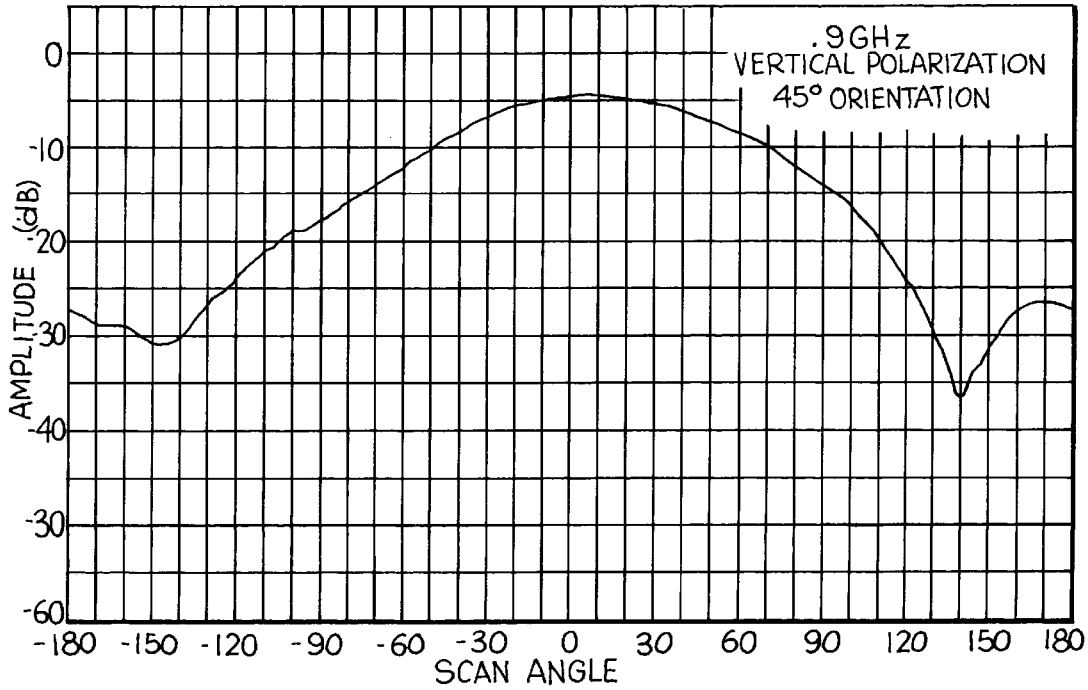

4A includes antennas 30, 34, 38 and 40 spaced as per array 32 and in addition includes an antenna 30' similar to antenna 30 with its center spiral portion 42' spaced as are antennas 34 and 38 and portion 42 to provide two linear high frequency arrays which can resolve the ambiguities previously discussed. Only two lower frequency portions 44 and 44' are provided since the ambiguities of the higher frequencies do not occur. Also since lower frequency emissions usually come from ground emitters whose location can be determined by other means, only azimuth information need be acquired. A more symmetrical array 118 is shown in FIG. 4B where antennas 30, 30' and 36 are combined for azimuth information and two properly spaced antennas 120 and 122 similar to antenna 36 are combined into a horizontal linear array to provide high frequency elevation information. In the array 124 of FIG. 4C antennas 30, 36 and 38 are combined with antennas 30' and 30" so that not only are two arrays of high frequency antennas formed like in array 116, low frequency elevation information can be obtained by using the cloverleaf portions 44 and 44".

Figure 6A:
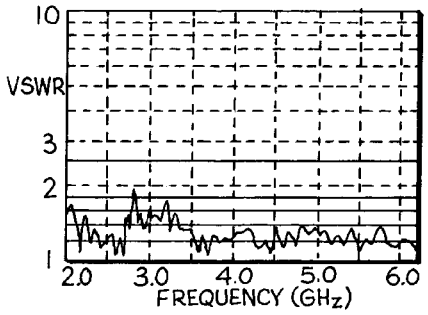
FIGS. 6A, 6B and 6C are VSWR measurements versus frequency for the center antenna of the cloverleaf array, the outer antenna of the cloverleaf array and the cloverleaf antenna of FIG. 2 respectively.
Figure 6B:
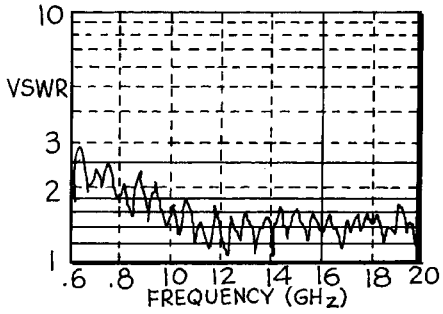
Figure 6C:
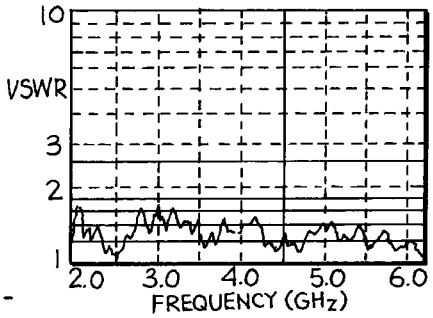
Figure 7:
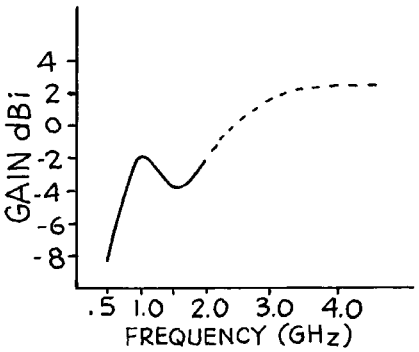
FIG. 7 is a graph of the gain versus frequency of the antenna of FIGS. 2 and 3.
Figure 8A:
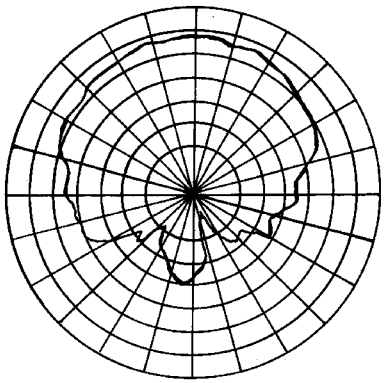
FIGS. 8A and 8B are an azimuth and elevation cuts of the patterns of the cloverleaf antenna of FIG. 2 with horizontal polarization at 0.9 GHz.
Figure 8B:
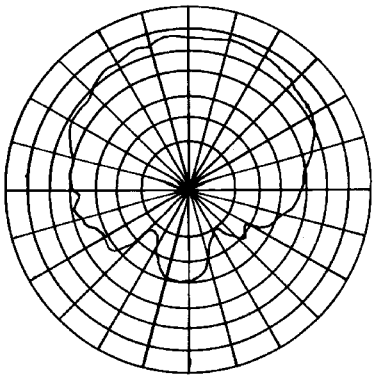

Two antennas as described herein actually have been constructed. The first was a complete antenna array such as shown in FIG. 2, consisting of the cloverleaf antenna 30 surrounded by four spiral antennas 34, 36, 38 and 40. The second was a stand-alone cloverleaf antenna 30 which can be used independently or in conjunction with a cloverleaf array 32 to obtain both amplitude and phase direction finding information. FIGS. 5, 6, 7 and 8 show the experimental results of such antenna. FIGS. 5A, 5B, 5C and 5D represent the horizontal and vertical polarization patterns through both the largest and smallest dimensions of the cloverleaf. FIGS. 6A, 6B and 6C show the VSWR of the cloverleaf antenna from the center of the cloverleaf array, the outer antenna of the cloverleaf array, and the cloverleaf element respectively. FIG. 7 is a graph of cloverleaf antenna gain versus frequency with the dashed portion thereof being projected data. FIGS. 8A and 8B show horizontal and vertical pattern cuts respectively on the cloverleaf antenna 30 without the surrounding array. As can be seen, the cloverleaf antenna 30 exhibits similar properties whether included in an array or not.

Thus there has been shown and described a novel antenna and antenna arrays which fulfill all the objects and advantages sought therefor. Many changes, alterations, modifications and other uses and applications of the subject invention will become apparent to those skilled in the art after considering this specification together with the accompanying drawings. All such changes, alterations and modifications which do not depart from the spirit and scope of the invention are deemed to be covered by the invention which is limited only by the claims which follow.

What is claimed is:

1. An antenna system including:

a first group of spiral elements positioned in a plane, said first group of spiral elements each having:

an inner circular portion; and an outer cloverleaf shaped portion positioned about said inner circular portion.

2. The antenna system defined in claim 1 wherein said outer cloverleaf shaped portion includes first, second, third, and fourth lobes radiating outwardly from said inner circular portion.

3. The antenna system defined in claim 2 wherein said inner circular portion includes:

innermost portions of said spiral elements; and signal connections at said innermost portions.

4. The antenna system defined in claim 3 wherein said outer cloverleaf shaped portion includes:

outermost rings of said spiral elements;

next to outermost rings of said spiral elements adjacent said outermost rings; and termination resistors connected between each of said outermost rings and said adjacent next to outermost rings.

5. The antenna system defined in claim 4 wherein said first group of spiral elements are a pair of spiral elements positioned in a plane.

6. The antenna system defined in claim 2 further including:

a second group of spiral elements formed into a circular antenna positioned generally between said first and second lobes;

a third group of spiral elements formed into a circular antenna positioned generally between said second and third lobes;

a fourth group of spiral elements formed into a circular antenna positioned generally between said third and fourth lobes; and a fifth group of spiral elements formed into a circular antenna positioned generally between said first and fourth lobes.

7. The antenna system defined in claim 6 wherein said second and third groups of spiral elements are spaced from said outer cloverleaf shaped portion of said first group of spiral elements a distance which is less than the distance said fourth and fifth groups of spiral elements are spaced from said outer cloverleaf shaped portion of said first group of spiral elements.

8. The antenna system defined in claim 2 further including:

a second group of spiral elements positioned adjacent said first group of spiral elements, said second spiral elements each having:

an inner circular portion; and an outer cloverleaf shaped portion positioned about said inner circular portion of said second group, said outer cloverleaf shaped portion including first, second, third, and fourth lobes radiating outwardly from said inner circular portion of said second group;

a third group of spiral elements formed into a circular antenna positioned generally between said first and second lobes of said first group of spiral elements and said third and fourth lobes of said second group of spiral elements;

a fourth group of spiral elements formed into a circular antenna positioned generally between said second and third lobes of said first group of spiral elements; and a fifth group of spiral elements formed into a circular antenna positioned generally between said first and fourth lobes of said first group of spiral elements.

9. The antenna system defined in claim 2 further including:

a second group of spiral elements positioned adjacent said first group of spiral elements, said second spiral elements each having:

an inner circular portion; and an outer cloverleaf shaped portion positioned about said inner circular portion of said second group, said outer cloverleaf shaped portion including first, second, third, and fourth lobes radiating outwardly from said inner circular portion of said second group;

a third group of spiral elements formed into a circular antenna positioned generally between said first and second lobes of said first group of spiral elements and said third and fourth lobes of said second group of spiral elements;

a fourth group of spiral elements formed into a circular antenna positioned generally facing said first lobe of said first group of spiral elements and said fourth lobe of said second group of spiral elements; and a fifth group of spiral elements formed into a circular antenna positioned generally facing said second lobe of said first group of spiral elements and said third lobe of said second group of spiral elements, said third, fourth and fifth groups of spiral elements being generally aligned, and said first, second, and fourth groups of spiral elements being generally aligned and positioned at about a right angle to said aligned third, fourth and fifth groups of spiral elements.

10. The antenna system defined in claim 2 further including:

a second group of spiral elements positioned adjacent said first group of spiral elements, said second spiral elements each having:

an inner circular portion; and an outer cloverleaf shaped portion positioned about said inner circular portion of said second group, said outer cloverleaf shaped portion including first, second, third, and fourth lobes radiating outwardly from said inner circular portion of said second group;

a third group of spiral elements positioned adjacent said first group of spiral elements, said third spiral elements each having:

an inner circular portion; and an outer cloverleaf shaped portion positioned about said inner circular portion of said third group, said outer cloverleaf shaped portion including first, second, third, and fourth lobes radiating outwardly from said inner circular portion of said third group;

a fourth group of spiral elements formed into a circular antenna positioned generally between said first and second lobes of said first group of spiral elements and said third and fourth lobes of said second group of spiral elements;

a fifth group of spiral elements formed into a circular antenna positioned generally between said second and third lobes of said first group of spiral elements and said first and fourth lobes of said third group of spiral elements, said first, second, and fourth groups of spiral elements being generally aligned, and said first, third, and fifth groups of spiral elements being generally aligned and positioned at about a right angle to said aligned first, second and fourth groups of spiral elements.

* * * * *